US010610927B2

(12) United States Patent
Heimann et al.

(10) Patent No.: US 10,610,927 B2
(45) Date of Patent: Apr. 7, 2020

(54) CONTINUOUS CASTING INSTALLATION FOR THIN SLABS

(71) Applicant: SMS GROUP GMBH, Düsseldorf (DE)

(72) Inventors: Thomas Heimann, Iserlohn (DE); Markus Reifferscheid, Korschenbroich (DE); Uwe Plociennik, Ratingen (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 15/531,309

(22) PCT Filed: Nov. 27, 2015

(86) PCT No.: PCT/EP2015/077909

§ 371 (c)(1),
(2) Date: May 26, 2017

(87) PCT Pub. No.: WO2016/083574

PCT Pub. Date: Jun. 2, 2016

(65) Prior Publication Data

US 2017/0341135 A1 Nov. 30, 2017

(30) Foreign Application Priority Data

Nov. 28, 2014 (DE) ..... 10 2014 224 390

(51) Int. Cl.
*B22D 11/128* (2006.01)
*B22D 11/126* (2006.01)
(Continued)

(52) U.S. Cl.
CPC ..... *B22D 11/1282* (2013.01); *B22D 11/041* (2013.01); *B22D 11/126* (2013.01); *B22D 11/1213* (2013.01)

(58) Field of Classification Search
CPC ... B22D 11/041; B22D 11/12; B22D 11/1213; B22D 11/126; B22D 11/128; B22D 11/1282
(Continued)

(56) References Cited

U.S. PATENT DOCUMENTS 4,420,029 A 12/1983 Kameyama et al.
5,065,811 A * 11/1991 Scholz et al. ..... B21B 1/46 164/263

(Continued)

FOREIGN PATENT DOCUMENTS

BE 727582 A 7/1969
DE 102006052138 A1 11/2007

(Continued)

OTHER PUBLICATIONS

20 Jahre CSP—Die Erfolgsgeschichte einer außergewöhnlichen Technologie, D. Rosenthal et al, "Stahl u. Eisen" 129 (2009), Heft 11, pp. 73-89.

(Continued)

*Primary Examiner* — Kevin P Kerns
(74) *Attorney, Agent, or Firm* — Lucas & Mercanti, LLP; Klaus P. Stoffel

(57) ABSTRACT

An apparatus for the continuous casting of thin slabs, having a strand guide, which is arranged downstream of a permanent mold in the casting direction and which guides the strand output from the permanent mold along a first direction, having an adjoining bending/straightening region, which a mechanism for driving and bending the strand in a second direction, which differs from the first direction, having a cutting device, which cuts the strand into thin slabs, and having a first furnace, which is provided for temperature compensation in the strand, wherein the first furnace extends
(Continued)

in an arched manner at least partially over the bending/straightening region and in part along the second direction.

13 Claims, 6 Drawing Sheets

(51) Int. Cl.
*B22D 11/041* (2006.01)
*B22D 11/12* (2006.01)

(58) Field of Classification Search
USPC ..... 164/263, 417, 441, 447, 460, 476, 477, 164/484
See application file for complete search history.

(56) References Cited

U.S. PATENT DOCUMENTS 5,307,864 A * 5/1994 Arvedi et al. ..... B21B 1/463 164/417
5,630,467 A 5/1997 Yoshimura
5,901,777 A 5/1999 Matsumura et al.
8,100,166 B2 1/2012 Bausch et al.
2007/0113610 A1* 5/2007 Rittner et al. ..... B21B 1/466 72/202
2012/0186773 A1* 7/2012 Shaber ..... B22D 11/1248 164/485
2014/0096578 A1* 4/2014 Eckerstorfer et al. .... B21B 1/46 72/40

FOREIGN PATENT DOCUMENTS

EP 0371281 B1 6/1990
EP 0707908 A1 4/1996
JP S5367810 U 6/1978
JP S58202958 A 11/1983
JP H11170020 A 6/1999
WO 2007101685 A1 9/2007

OTHER PUBLICATIONS

Chinese Office Action and English Translation, Appl No. 2015800713586, dated Sep. 23, 2019, 12 Pages.

* cited by examiner

CONTINUOUS CASTING INSTALLATION FOR THIN SLABS

The present application is a 371 of International application PCT/EP2015/077909, filed Nov. 27, 2015, which claims priority of DE 10 2014 224 390.4, filed Nov. 28, 2014, the priority of these applications is hereby claimed and these applications are incorporated herein by reference.

TECHNICAL FIELD

The invention relates to a device for the continuous casting of thin slabs, having a strand guide that in the casting direction is arranged behind a permanent mold; a bending/straightening region which adjoins said strand guide, for diverting the cast strand; a cutting installation for cutting the strand into thin slabs; and a furnace which is provided for equalizing the temperature in the strand.

BACKGROUND OF THE INVENTION

A method for the continuous casting of thin slabs was introduced at the end of the eighties, said method then having become popular in the industry under the name of "compact strip production" (CSP). It was an object at the time to refine conventional continuous casting toward "close-to-final-dimension" casting, that is to say to ultimately cast the slabs so thin such that only the minimum deformation required for reasons of material and forming technology had to be applied in the rolling mill, and that the scope of the rolling stage could thus be reduced.

A plant for casting thin slabs can be derived from WO 2007/101685 A1, for example. After the permanent mold, the cast strand is guided vertically downward by means of a strand guide. When the strand leaves the strand guide, the former is solidified to the core. The cast strand is bent and straightened only upon solidification to the core, so as to avoid any undesired elongation of the strand and any formation of fissures. By virtue of the strand being guided vertically downward and subsequently being diverted to the horizontal, this type of plant is also referred to as a vertical bending plant. A temperature equalization furnace which is not discussed in more detail in the WO publication follows bending and straightening.

FIG. 1*a* shows a vertical bending plant from the prior art. A funnel-type permanent mold from which the cast steel exits as a strand 1 in a vertically downward manner is identified by the reference sign 10. The strand 1 thus demolded is subsequently guided along a strand guide 20 (continuing in a vertically downward manner) and is cooled by means of cooling segments 30. The cooling segments 30 form the so-called secondary cooling. The strand 1 is completely solidified at or shortly before the end of the last cooling segment 30. The strand 1 subsequently makes its way below the strand guide 20 into the bending region 40 where said strand 1 is exposed to bending forces, on the one hand, and is actively driven in the conveying direction, on the other hand. This is performed by means of rollers and roller pairs 41, the position of which can be derived from FIG. 1*a*. The straightening region 50 in which the strand 1 is brought to the horizontal alignment adjoins the bending region 40. Rollers 51 are provided here too. One or a plurality of the rollers 41, 51 is/are drive rollers and propel the strand in the transportation direction; other rollers 41, 51 serve for guiding and straightening the strand 1. To this extent, the rollers 41 and 51 form means for driving and bending the strand. The strand 1 by means of a cutting installation 60 (also referred to simply as scissors in some of the figures) is subsequently cut into thin slabs. The singularized slabs are not plotted separately in FIG. 1*a*. The slabs subsequently run into a furnace 70, the entry of the latter being identified by the reference sign 71. The furnace 70 is embodied as a tunnel furnace and serves as the connection between the casting machine and rolling mill (not illustrated) and for equalizing the thin-slab temperature (when viewed in the cross-sectional direction of the slab). The transportation direction of the strand 1 or of the slabs, respectively, is indicated by an arrow line T.

An exemplary temperature profile of the strand 1 along the transportation direction is shown in FIG. 1*b*. The graph shows the temperature profile on the surface of the strand 1, in the core, and the average temperature as a function of distance, proceeding from the meniscus on the permanent mold, for a low-carbon material having a slab size of 1600 mm×60 mm at a casting speed of 5.2 m/min. The solidification to the core is approx. 7.4 m, approximately 0.5 m ahead of the last roller of the cooling segments 30. By way of radiation and of contact with the rollers 41, 51, the average temperature of the strand 1 severely decreases between the end of the cooling segments 30 via the bending region 40, the straightening region 50, and the cutting installation 60, up to the furnace entry 71. The average temperature drops from approx. 1247° C. after the cooling segments 30, by approx. 200° C. to approx. 1041° C.

An alternative and more compact construction mode of the CSP plant is shown in FIG. 2*a*. An exemplary temperature profile of the strand 1 along the transportation direction can be derived from FIG. 2*b*. In a manner analogous to that of FIG. 1*b*, the graph of FIG. 2*b* shows the temperature profile on the surface of the strand 1, in the core, and the average temperature as a function of distance, proceeding from the meniscus on the permanent mold, for a low-carbon material having a slab size of 1350 mm×40 mm at a casting speed of 4 m/min. By contrast to the construction mode of FIG. 1*a*, only two cooling segments 30 are provided here, and the strand guide 20 is configured so as to be somewhat shorter overall. The plant thus has fewer segments and has a lower overall construction height. The solidification point is shortly before the last roller of the cooling segments 30. Here too, the average temperature drops by approx. 200° C., from 1246° C. to 1041° C.

SUMMARY OF THE INVENTION

An object of the invention lies in specifying a device for the continuous casting of thin slabs having an improved energy efficiency and/or a reduced construction height.

The device according to the invention is conceived for the continuous casting of thin slabs. Slabs having a thickness between 35 mm and 90 mm, preferably between 40 mm and 60 mm are particularly considered to be thin slabs. The casting of thin slabs was devoid of a technical solution for a long time, since the thin material is susceptible to elongation and fissures. Apart from other aspects, the subject matter of research and development was on diverting and straightening the thin strand. Therefore, any comparison with plants for casting thick slabs is not readily possible.

The device according to the invention has a strand guide which in the casting direction follows a funnel-shaped permanent casting mold. The steel which is still molten in the core exits the permanent mold and solidifies from the outside to the inside while said steel is being guided by the strand guide. One or a plurality of cooling segments are preferably provided for more rapid cooling. The strand guide and the cooling segments are aligned along a first direction which preferably runs from top to bottom, substantially parallel with the direction of gravity. The strand is completely solidified at the end, or shortly before the end, of the strand guide, or of the cooling segments, respectively. A bending/straightening region which has means for driving and bending the strand in a second direction which differs from the first direction is located so as to adjoin said strand guide or said cooling segments, respectively. The mentioned means for driving and bending preferably comprise rollers and/or roller pairs of which at least part can be actively driven so as to convey the strand along the transportation direction. The second direction is preferably provided so as to be substantially horizontal in order for the strand to be able to be guided onward to a rolling mill (not part of the device described herein) in this way. On the way to said rolling mill the strand is cut into thin slabs by means of a cutting installation.

The device furthermore has a first furnace which is provided for equalizing the temperature in the strand, more specifically along the cross section that is perpendicular to the longitudinal extent of said strand. The first furnace extends in an arcuate manner at least partially across the bending/straightening region and in part along the second direction. The furnace is preferably configured as a tunnel furnace. The cutting installation herein is preferably located behind the first furnace so as to be able to reposition the furnace as much as possible toward the front, in the direction of the permanent mold.

One technical effect of the invention lies in that the average temperature of the strand between the exit from the last cooling segment up to the cutting installation drops less severely since the strand, by virtue of the curved first furnace that is lengthened toward the front, enters the temperature equalization furnace earlier. Lengthening of the furnace toward the front is a technical innovation which is removed from the earlier perception that there should be no furnace in the bending and/or straightening region, in order for this critical region to remain accessible, on the one hand, and for no temperature equalization to be performed in the strand while the strand is being bent and straightened, on the other hand. Lower energy costs are one positive consequence of the innovation illustrated here. This is amplified when the furnace has to be heated only prior to the start of casting and in the case of low casting speeds, and otherwise can be utilized for passive thermal equalization. Since the temperature does not drop that severely, less precipitation is created, on account of which the risk of fissures is reduced, and the mechanical properties of the slabs are improved. The growth in scale is reduced by the oxygen-starved furnace atmosphere, leading to higher output. Overall, the furnace can be constructed in a more compact manner, and the production shed can be constructed in a shorter manner.

As has already been mentioned, one or a plurality of cooling segments for cooling the strand is/are preferably provided in the region of the strand guide. Said cooling segments accelerate cooling and moreover enable improved control of the cooling procedure. The strand is solidified to the core at or shortly before the end of the last cooling segment and can be diverted by the bending/straightening region.

The first furnace is preferably curved in a range between 10° and 80°. Even a small forward lengthening by 10° forward into the straightening region achieves a reduction in the temperature drop of the strand. A lengthening beyond 80° is difficult to implement in technical terms. A spacing between the end of the strand guide, or between the end of the last cooling segment, respectively, and the furnace entry is desirable for reasons of maintenance and other reasons. However, the furnace should tend to be constructed so as to be as close as possible to the end of the strand guide or of the cooling, respectively, since the hot strand radiates much heat specifically at high temperatures.

In order for the invention to be able to be integrated in existing plants (for example in order to avoid having to relocate the cutting installation), according to one further preferred exemplary embodiment a second furnace is provided behind the first furnace, and the cutting installation is provided between the two furnaces. The second furnace preferably extends completely along the second direction and is not curved. In many cases, the second furnace can be embodied so as to be shorter than the first furnace, since the former is optionally responsible only for equalizing the temperature gradient which has built up on the short open section on the cutting installation.

The bending/straightening region is preferably constructed from a bending region having bending rollers and by a straightening region having straightening rollers, wherein one or a plurality of the bending rollers and/or straightening rollers is/are disposed in the first furnace. For a long time, the open guiding in the bending/straightening region has been considered to be indispensable in the casting of thin slabs. This technical prejudice is hereby overcome; in particular, the means for driving and bending the strand can be partially or completely provided in the furnace without these technical measures having a negative effect on the quality of the thin slabs. To this end, the means, for instance the rollers, for driving and bending the strand which are located in the furnace have to be made from a heat-resistant material. Alternatively or additionally, a cooling installation for cooling the corresponding means can also be provided. The technical measures mentioned, (cooling and/or heat-resistant material) particularly preferably apply to the so-called straightening rollers in the straightening region.

A water wiper for removing splash water is preferably provided ahead of the entry to the first furnace. In that the furnace is lengthened toward the front and is curved upward, it can be prevented that water ingresses into the furnace. The water wiper can be implemented for instance by means of one or a plurality of wiper plates and/or of air pressure and/or of water blasting and/or by means of a suction installation.

The bending/straightening region is potentially more difficult to access and visually check from the outside in that the region of diverting and straightening is utilized for equalizing the temperature in the strand. In order to overcome difficulties that arise therefrom, various technical measures can be provided. For example, the region at the entry of the first furnace is preferably designed such that a strand, for instance the cold strand and/or the strand in the case of damage, can be directed past the furnace. This can be achieved by beveling the furnace entry. Alternatively or additionally, the furnace entry or the forward region of the first furnace is configured so as to be displaceable at least on the lower side. In order for the process sequence to be able to be supervised in a comfortable manner and for the threading of the strand into the bending/straightening region to be able to be designed in a simpler manner, one or a plurality of heat-resistant cameras is/are preferably provided in the first furnace. For the same reason, one or a plurality of rollers is/are preferably provided so as to be displaceable in the bending/straightening region. This preferably applies in particular to the rollers in the region of the furnace entry.

Whilst the present invention is applied in the technical field of continuous casting plants for thin slabs, the invention can optionally also be implemented in other fields. Further advantages and features of the present invention can moreover be derived from the following description of preferred exemplary embodiments. To the extent that the features are not mutually exclusive, the features described therein can be implemented individually or in combination with one or a plurality of the features mentioned above. The following description of preferred exemplary embodiments refers to the appended drawings.

DETAILED DESCRIPTION OF THE INVENTION

Exemplary embodiments of the invention will be described in detail hereunder with reference to the drawings. It is to be pointed out that the exemplary embodiments described herein are not intended to limit the invention but to explain the invention, wherein the features or combination of features of the exemplary embodiments presented do not always have to be essential to the invention.

Figure 3:
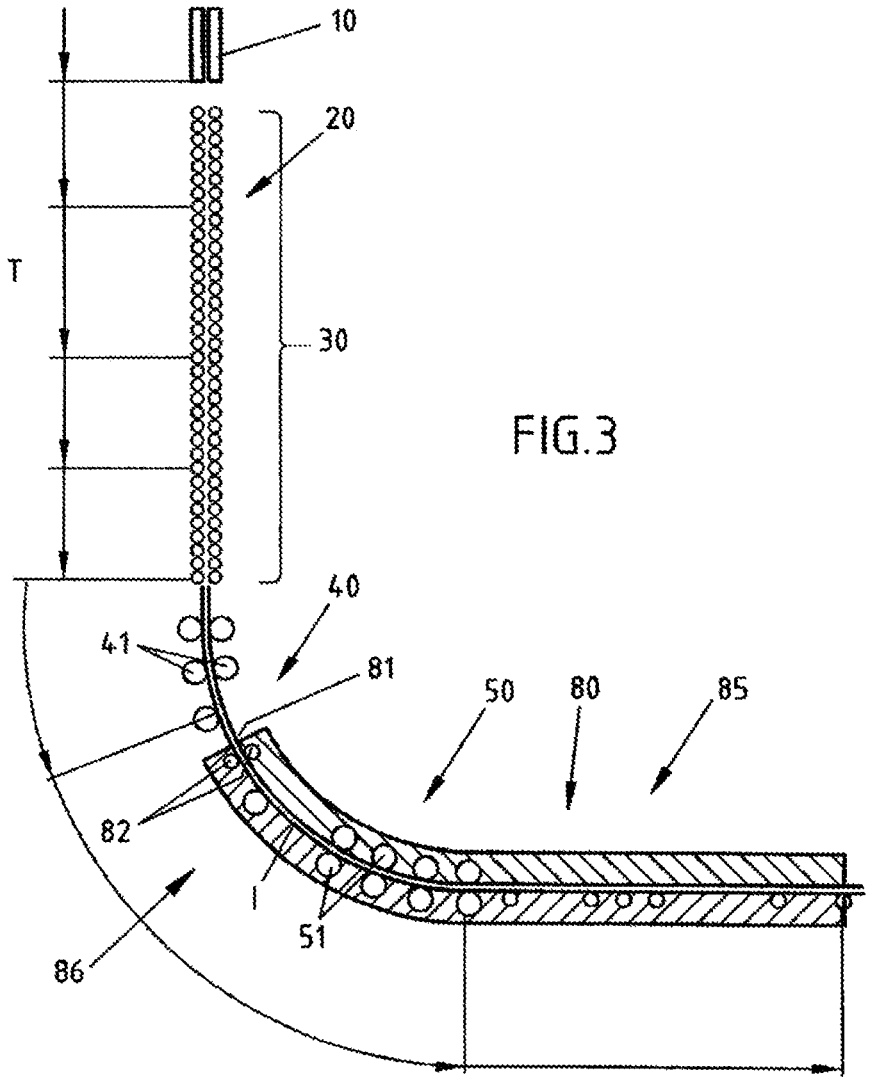
FIG. 3 shows a CSP plant according to one exemplary embodiment, having a curved furnace.

FIG. 3 shows a vertical bending plant according to a first exemplary embodiment. A funnel-type permanent mold from which the cast steel exits as a strand 1 in a vertically downward manner is identified by the reference sign 10. The strand 1 thus demolded is subsequently guided along a strand guide 20 (in continuing vertically downward manner) and is cooled by means of cooling segments 30. The cooling segments 30 form the so-called secondary cooling. The strand 1 is completely solidified at or shortly before the end of the last cooling segment 30. The strand 1 subsequently makes its way below the strand guide 20 into the bending region 40 where said strand 1 is exposed to bending forces. This is performed by means of rollers and roller pairs 41, the position of which can be derived from FIG. 1*a*. The straightening region 50 in which the strand 1 is brought to the horizontal alignment adjoins the bending region 40. Rollers 51 are provided here too. One or a plurality of the rollers 51 is/are drive rollers and propel the strand in the transportation direction; other rollers 41, 51 serve for guiding and straightening the strand 1. To this extent, the rollers 41 and 51 form means for driving and bending the strand.

Figure 1A:
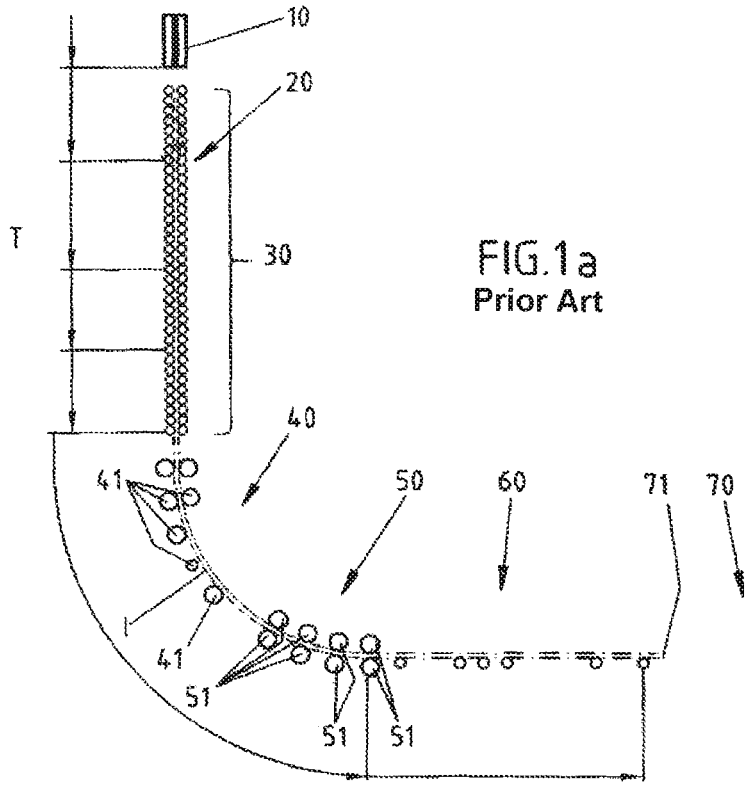
FIG.1a Prior Art
FIG. 1*a* shows a conventional CSP plant having a horizontal furnace.
Figure 1B:
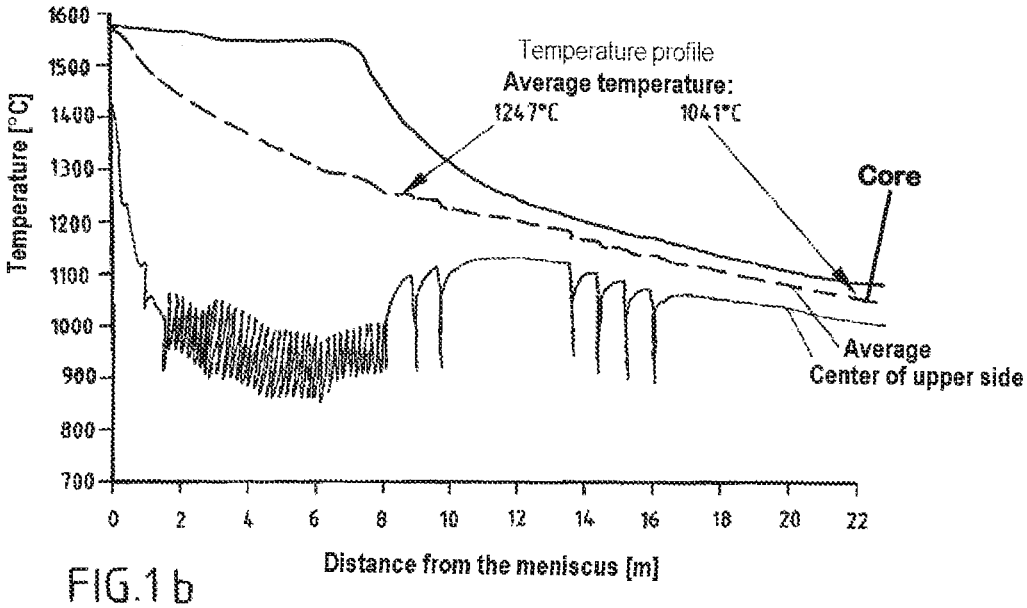
FIG.1b Prior Art
FIG. 1*b* shows temperature profiles of a strand cast therewith, as a function of the distance from the meniscus.

By contrast to the plant of FIG. 1*a*, no cutting installation 60 is illustrated in FIG. 3, since said cutting installation 60 is located behind the furnace 80. The furnace 80 has a horizontal portion 85 (generally a portion along the second direction) and a curved portion 86 which extends at least partially across the bending/straightening region 40, 50. As compared to the plant of FIG. 1*a*, the furnace 80 is thus lengthened toward the front, in the direction of the permanent mold 10, into or beyond the straightening region 50. The furnace 80 is preferably embodied as a tunnel furnace and serves for equalizing the temperature in the strand. The strand 1 is subsequently cut into thin slabs by means of the cutting installation 60 (not illustrated). The transportation direction of the strand 1 is indicated by an arrow line T.

The arc length of the portion 86 of the furnace is preferably in the range from 10° to 80°. Already a minor lengthening of 10° into the straightening region 50 achieves a significant reduction in the temperature drop of the strand 1. A lengthening beyond 80° is difficult to implement in technical terms. The strand 1 should preferably be completely solidified ahead of the furnace entry 80, on the one hand, while a spacing between the end of the strand guide 20, or between the end of the last cooling segment 30 and the furnace entry 81, respectively, for reasons of maintenance and other reasons which will become evident further below, is desirable, on the other hand. However, the furnace 80 should tend to be constructed so as to be as close as possible to the end of the cooling segments 30, since the hot strand 1 radiates much heat specifically at high temperatures.

Figure 5A:
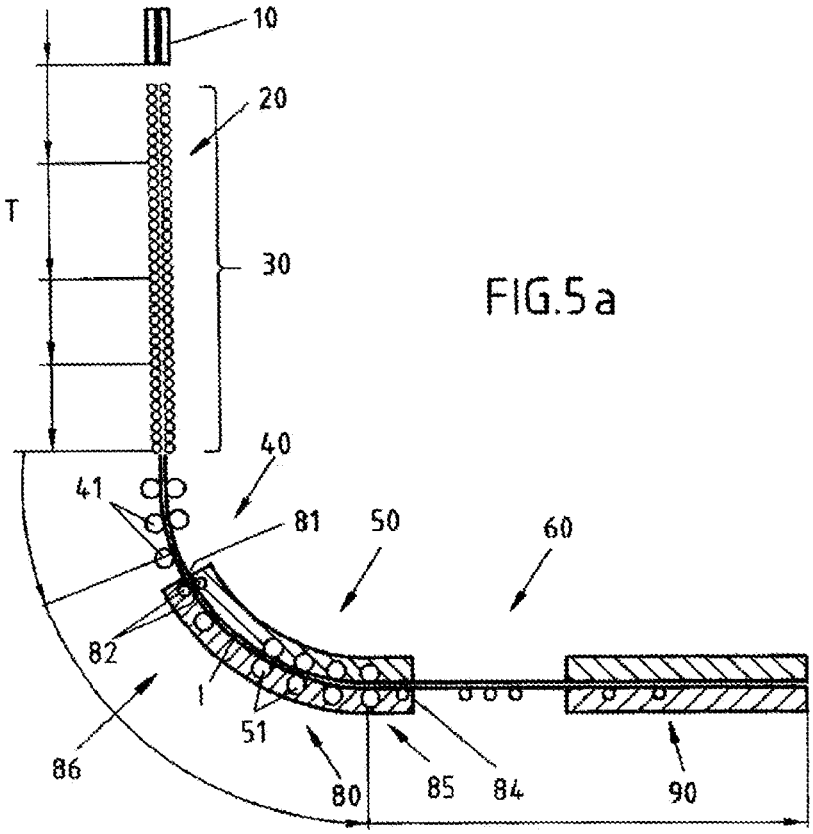
FIG. 5*a* shows a CSP plant according to a further exemplary embodiment, having two furnaces.

Following on from the furnace 80, the strand 1 is cut into thin slabs by means of the cutting installation 60 (not illustrated in FIG. 3). FIG. 5*a* which, except for the embodiment of the furnace 80 and the position of the cutting installation 60, is similar to the plant of FIG. 3, shows that the positioning of the cutting installation 60 can also be performed differently. The cutting installation in FIG. 5*a* keeps the conventional position thereof (as compared to the plant of FIG. 1*a*). To this end, the cutting installation 60 is located in an intermediate space between the furnace 80, which in this context is also referred to as the first furnace, and a second furnace 90. The second furnace is provided so as to be entirely horizontal, or along the second direction, respectively.

In that the furnace 80 is lengthened toward the front and is curved, it cannot be entirely precluded that residual splash water can ingress into the furnace 80. For this reason, a water wiper (not illustrated) is preferably provided ahead of the furnace entry 81. The water wiper can be implemented for instance by means or one or a plurality of wiping plates and/or air pressure and/or water blasting and/or by means of a suction installation.

Figure 4:
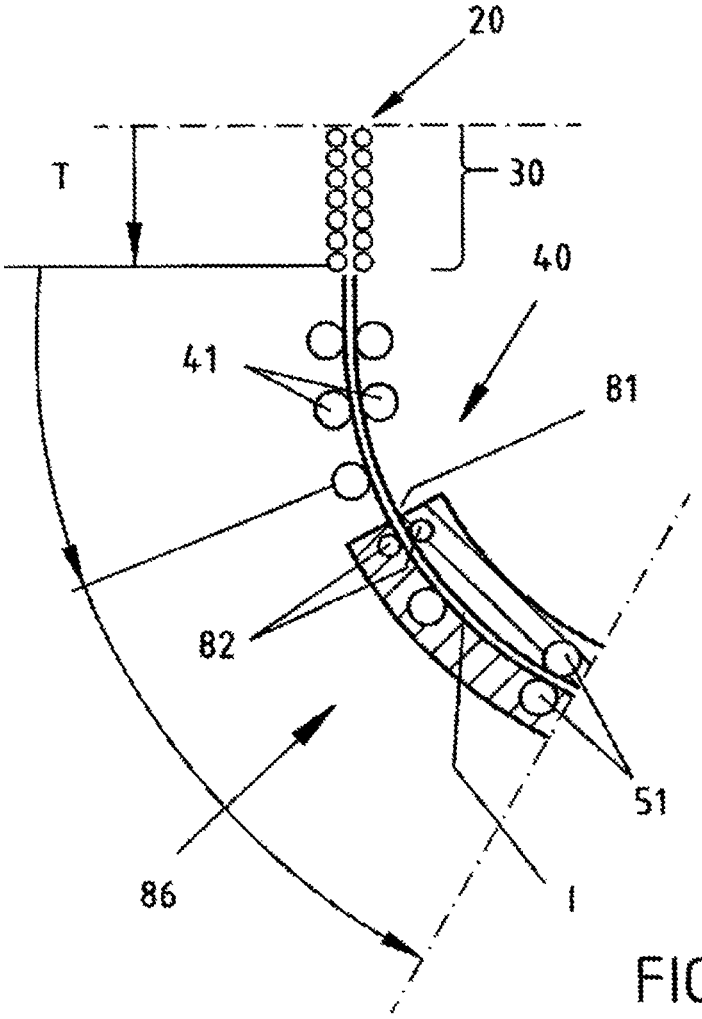
FIG. 4 shows an enlarged fragment of the furnace entry of the exemplary embodiment of FIG. 3.

The furnace entry 81 is preferably configured such that the dummy strand, in particular when being threaded out (not illustrated in the figures), or the strand 1 in the case of damage can be directed past the furnace 80. This can be achieved by beveling the furnace entry 81, as is shown in FIG. 4. Alternatively or additionally, the furnace entry 81 or the front region of the furnace 80 is configured so as to be displaceable at least on the lower side, this also including any potential pivoting movement. "Dummy strand" herein is understood to be that strand that is introduced into the casting plant prior to the start of casting. The liquid material is cast onto this dummy strand. The dummy strand serves to prevent the material that at the start of casting is still liquid from rapidly flowing through the cooling segments 30 but instead to first form a firm strand trough and to subsequently be slowly drawn conjointly with the dummy strand through the secondary cooling segments 30. The material after cooling is solidified to the core and can be guided onward without the dummy strand. According to this embodiment, this dummy strand is to be separated from the real strand 1 ahead of the furnace 80 and to be removed in a vertically downward manner. The dummy strand can be made as a dummy strand chain.

One or a plurality of the rollers 41, 51 is/are provided so as to be displaceable in order for threading of the strand 1 into the furnace 80 to be facilitated. In particular, the positions of the two entry rollers which are identified by the reference sign 82 are preferably provided so as to be modifiable. However, a displacing capability of this type can also be provided for other rollers, in particular for the straightening rollers 51. To this end, the furnace 80 has to offer sufficient space in an upward direction in order for the straightening rollers 51 to be able to be opened out sufficiently in relation to the strand guide 20. The setting of the respective rollers 41, 51 in the furnace 80, the diverging of roller pairs, etc., can be implemented by means of a hydraulic controller. In order for the threading to be able to be observed from outside the furnace, one or a plurality of heat-resistant cameras (not illustrated) is/are preferably installed in the furnace 80.

The furnace 80, or part thereof, can be conceived as a passive furnace which is actively heated only in the case of the start of casting or at low casting speeds (comparatively low average temperature); said furnace 80 otherwise serves as a good insulation. Whether the furnace 80 is operated as an active or a passive furnace can vary depending on the individual situation, and depends heavily on the specific casting conditions. Examples thereof will be discussed further below.

In order to avoid that the straightening rollers 51 are damaged by the high environmental temperatures, said straightening rollers 51 are preferably cooled. Alternatively, the rollers 51 are made from a high-strength and heat-resistant material such that no heat is dissipated by way of the rollers 51. These exemplary embodiments can be applied in an analogous manner to other rollers of the bending/straightening region.

FIG. 5*a*, introduced above, shows an exemplary embodiment that is similar to that of FIG. 3. However, two furnaces 80 and 90 are provided instead of one furnace 80, the cutting installation 60 being disposed between said furnaces 80 and 90.

Figure 5B:
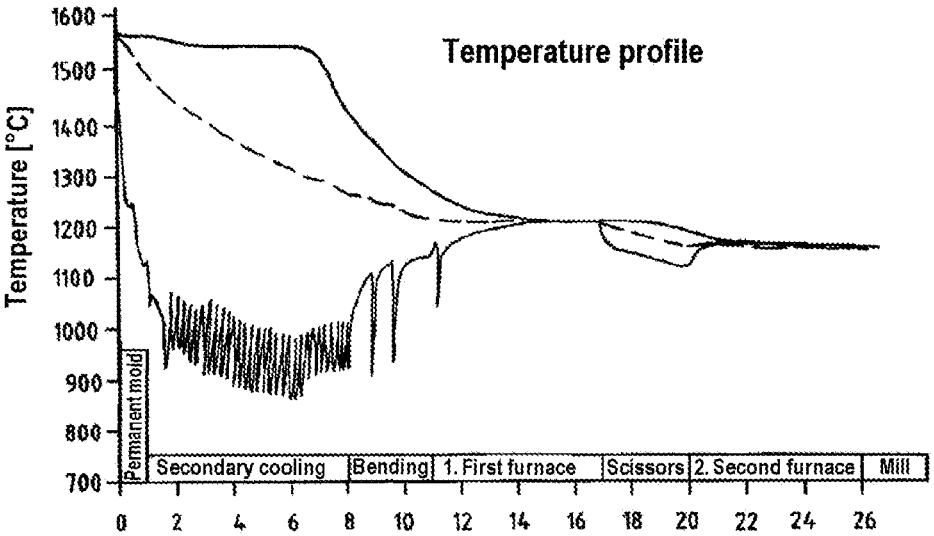
FIG. 5*b* shows a temperature profile of a strand cast therewith, as a function of the distance from the meniscus.

A special operating configuration of this plant is to be described hereunder. To this end, an exemplary temperature profile of the strand 1 along the transportation direction is shown in FIG. 5*b*. The graph shows the temperature profile on the surface of the strand 1, in the core, and the average temperature as a function of distance, proceeding from the meniscus on the permanent mold, for a low-carbon material having a slab size of 1600 mm×60 mm at a casting speed of 5.2 m/min.

According to this example, the 60 mm thick strand is cast in the CSP plant so as to have a metallurgical length of approximately 8 m. A low-carbon material having a liquidus temperature of 1529° C. and a solidus temperature of 1499° C. in the case of superheating at 25° C. solidifies after approximately 7.4 m. The average temperature at the end of the cooling segments 30 at approx. 8 m is approximately 1250° C., and by radiation and contact with the bending rollers 41 up to the furnace entry 81 at approx. 11 m drops to approximately 1200° C. The first furnace 80 in this example is approximately 6 m long and does not have to actively heat the strand 1 at this casting speed. However, said first furnace 80 does have to be heated up to 1200° C. at least prior to the first casting. Furthermore, said first furnace 80 is conceived as an active furnace for comparatively low casting speeds or in the case of a comparatively thin material of the strand 1. It is furthermore assumed that the straightening rollers 51 that are located in the first furnace 80 do not substantially extract heat from the strand 1. At the furnace exit, which is identified by the reference sign 84, the temperature in the strand 1 after approx. 17 m has been equalized and at each cross-sectional position is approximately 1200° C. The cutting installation 60 can be located over the next 3 m. The average temperature of the strand 1, by way of the free thermal radiation and by contact with the rollers, drops by approx. 50° C. to approximately 1150° C. The strand 1 now reaches the second furnace 90. Therein, an equalization of temperature is performed anew. Behind the second furnace 90 which is typically shorter than the first furnace 80 and in the present example has a length of 5 m, the temperature in the strand 1 has again been equalized, optionally without active heating, and the strand 1 can run directly into the adjoining rolling mill. In order for lower temperatures to be obtained upon secondary cooling, and in order to have sufficient safety zones in the case of malfunctions, the furnaces 80, 90 can be constructed so as to be substantially longer, and the position of the cutting installation 60 could be located further to the rear.

Figure 2A:
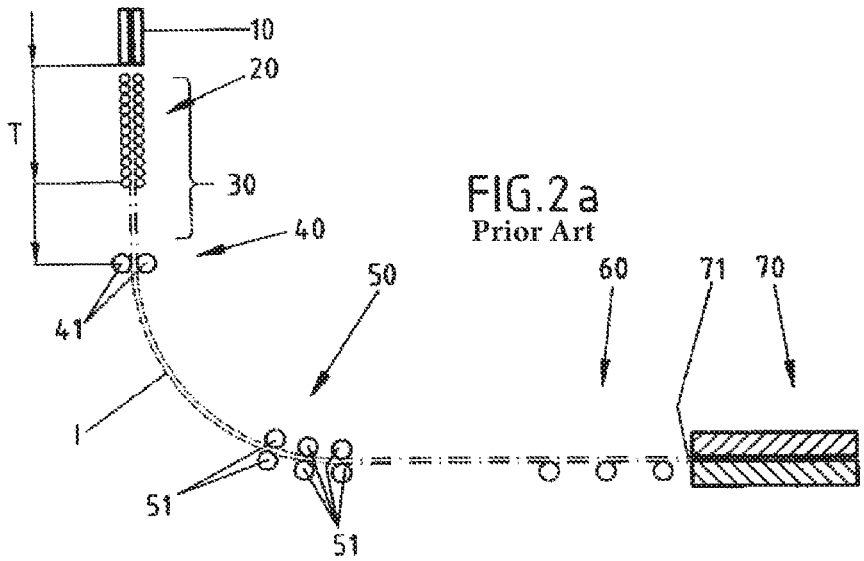
FIG.2 a Prior Art
FIG. 2*a* shows a conventional CSP plant having a horizontal furnace.
Figure 2B:
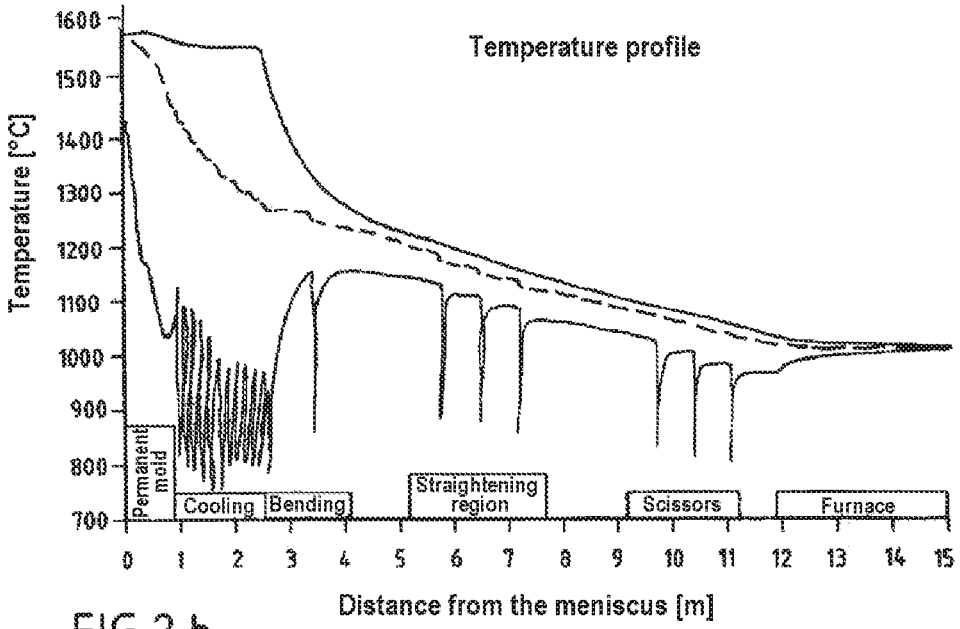
FIG.2 b Prior Art
FIG. 2*b* shows temperature profiles of a strand cast therewith, as a function of the distance from the meniscus.
Figure 6A:
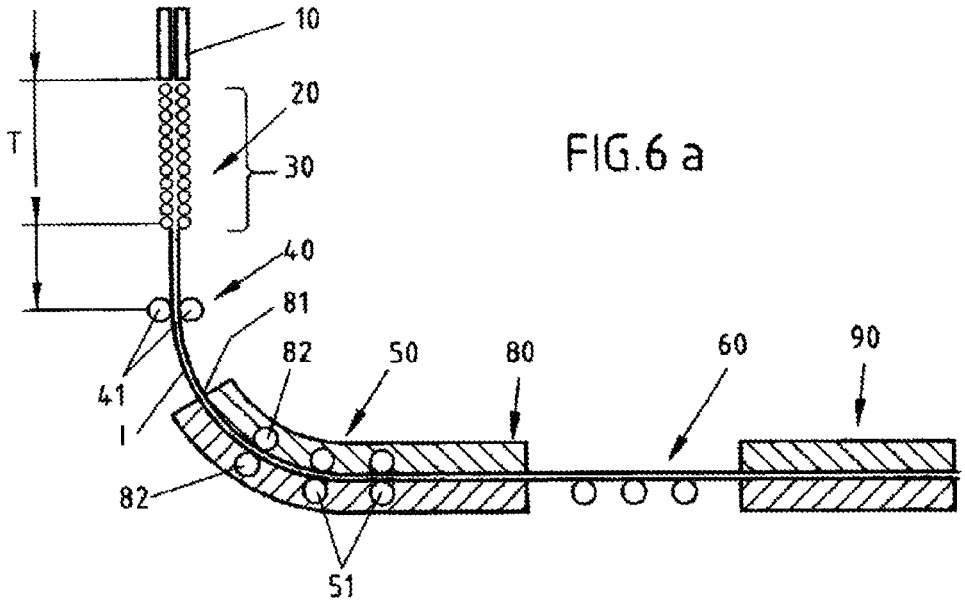
FIG. 6*a* shows a CSP compact plant according to a further exemplary embodiment, having two furnaces.
Figure 6B:
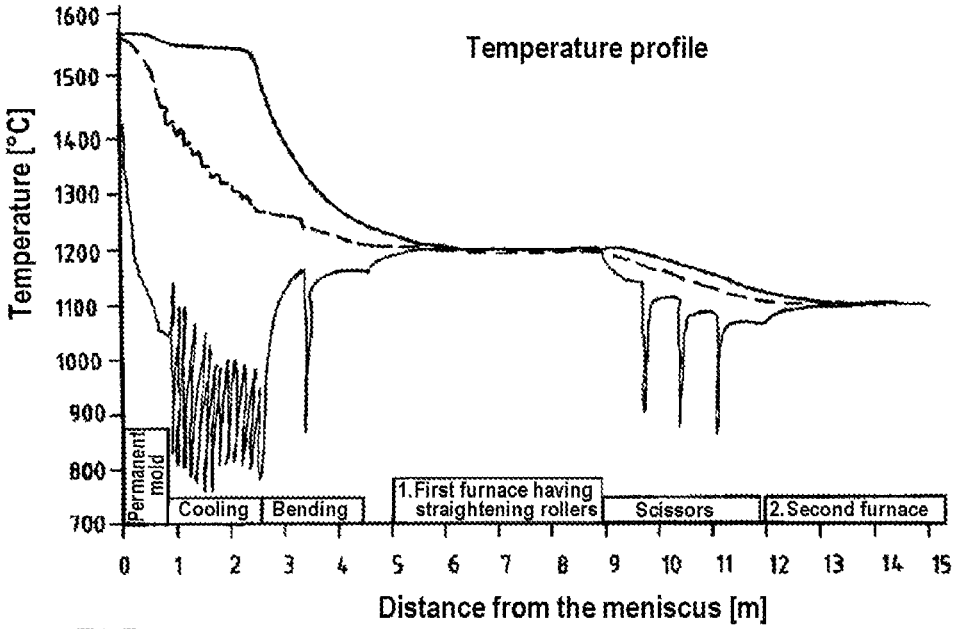
FIG. 6*b* shows a temperature profile of a strand cast therewith, as a function of the spacing from the meniscus.

An alternative exemplary embodiment which is loosely based on the compact plant of FIG. 2*a* is shown in FIG. 6*a*. The temperature profile of the plant is derived from FIG. 6*b*. In a manner analogous to that of FIG. 2*b*, the graph of FIG. 6*b* shows the temperature profile on the surface of the strand 1, in the core, and the average temperature as a function of distance, proceeding from the meniscus on the permanent mold, for a low-carbon material having a slab size of 1350 mm×40 mm at a casting speed of 4 m/min. Moreover, the same construction of the individual components and the functions thereof still apply, and a repeat of the description is dispensed with for the sake of avoiding redundancy.

It is a common feature of all exemplary embodiments that the average temperature of the strand 1 between the exit from the last cooling segment 30 up to the cutting installation 60 drops less severely than is the case with plants according to FIGS. 1*a* and 2*a*, for instance. This is clearly derived from a comparison of the respective temperature profiles.

Lower energy costs are one positive consequence. This is amplified when the furnace 80 and/or 90 has to be heated only prior to the start of casting and in the case of low casting speeds, and otherwise can be utilized for passive thermal equalization. Since the temperature does not drop so severely, less precipitation is created, on account of which the risk of fissures is reduced, and the mechanical properties of the slabs are improved. The growth in scale is reduced by the oxygen-starved furnace atmosphere, leading to higher output. Overall, the furnace can be constructed in a more compact manner, and the production shed can thus be constructed in a shorter manner. Even when a cutting installation is installed between two furnaces 80 and 90 (approx. 3 m free radiation) the average strand temperature is still sufficiently high for the adjoining rolling mill.

To the extent that they are applicable, all individual features which are illustrated in the exemplary embodiments can be combined with one another and/or replaced by one another without departing from the scope of the invention.

LIST OF REFERENCE SIGNS

1 Strand
10 Permanent mold

20 Strand guide
30 Cooling segments
40 Bending region
41 Rollers of the bending region
50 Straightening region
51 Straightening rollers
60 Cutting installation
70 Furnace
71 Furnace entry
80 First furnace
81 Furnace entry
82 Entry rollers
84 Furnace exit
85 Furnace portion along the second direction
86 Curved furnace portion
90 Second furnace
T Transportation direction of the strand or of the thin slabs, respectively

The invention claimed is:

1. A device for continuous casting of thin slabs, comprising: a permanent mold; a strand guide that, in a casting direction, is disposed behind the permanent mold and guides a strand that is delivered by the permanent mold along a first direction; a bending/straightening region that adjoins said strand guide and has means for driving and bending the strand in a second, horizontal direction that differs from the first direction; a cutting installation that cuts the strand into thin slabs; and a first furnace provided for equalizing temperature in an entire cross-section of the strand, wherein the first furnace is arranged downstream of the strand guide so as to be the first furnace encountered by the strand in the casting direction after leaving the strand guide, wherein the first furnace extends in an arcuate manner at least partially across the bending/straightening region and in part entirely horizontally along the second direction in a horizontal region so that the first furnace overlaps the bending/straightening region and the horizontal region.

2. The device according to claim 1, further comprising at least one cooling segment provided in a region of the strand guide for cooling the strand.

3. The device according to claim 1, wherein the first furnace is curved in a range between 10° and 80°.

4. The device according to claim 1, wherein the device is configured for casting thin slabs having a thickness between 35 mm and 90 mm.

5. The device according to claim 4, wherein the device is configured for casting thin slabs having a thickness between 40 mm and 60 mm.

6. The device according to claim 1, wherein the cutting installation is disposed, in the casting direction, behind the first furnace.

7. The device according to claim 1, further comprising a second furnace behind the first furnace, the cutting installation being provided between the two furnaces.

8. The device according to claim 1, wherein the bending/straightening region is formed by a bending region having bending rollers, and by a straightening region having straightening rollers, wherein at least one of the bending rollers and/or the straightening rollers is disposed in the first furnace.

9. The device according to claim 1, further comprising a water wiper for removing splash water provided ahead of an entry to the first furnace.

10. The device according to claim 1, wherein a region at an entry of the first furnace is configured so that a strand is directable past the first furnace.

11. The device according to claim 9, wherein a forward region of the first furnace is configured so as to be displaceable and/or pivotable.

12. The device according to claim 1, further comprising at least one heat-resistant camera provided in the first furnace.

13. The device according to claim 1, wherein at least one roller is displaceable in the bending/straightening region.

* * * * *